US007411490B2

(12) United States Patent
Perkinson et al.

(10) Patent No.: US 7,411,490 B2
(45) Date of Patent: Aug. 12, 2008

(54) SECURITY MONITORING METHODOLOGY USING DIGITAL AUDIO

(75) Inventors: Charles Perkinson, Orlando, FL (US); Patrick Lusaka, Apopka, FL (US)

(73) Assignee: Infrasafe, Inc., Orlando, FL (US)

( * ) Notice: Subject to any disclaimer, the term of this patent is extended or adjusted under 35 U.S.C. 154(b) by 376 days.

(21) Appl. No.: 11/117,310

(22) Filed: Apr. 29, 2005

(65) Prior Publication Data

US 2005/0242945 A1 Nov. 3, 2005

Related U.S. Application Data

(60) Provisional application No. 60/566,607, filed on Apr. 30, 2004.

(51) Int. Cl.
*G08B 1/00* (2006.01)

(52) U.S. Cl. ..... 340/531; 340/506; 340/825.36; 340/825.49

(58) Field of Classification Search ..... 340/506, 340/517, 521, 524, 525, 825.36, 825.49, 340/531

See application file for complete search history.

(56) References Cited

U.S. PATENT DOCUMENTS 5,400,246 A * 3/1995 Wilson et al. ..... 700/17

* cited by examiner

*Primary Examiner*—Daryl C Pope
(74) *Attorney, Agent, or Firm*—The Nath Law Group; Jerald L. Meyer; Derek Richmond

(57) ABSTRACT

A security monitoring methodology and device using digital audio. A security control device integrates physical intrusion detection functions, physical access control functions, and compressed, streaming, digital audio transmission capability. The device provides interfaces for a number of sensor inputs, including standard alarm monitoring sensors and audio sensors. The device is capable of communicating with a monitoring system over a variety of digital networking configurations options, including TCP/IP, via embedded Ethernet interface, or serial modem communications over telephone or digital cellular networks using PPP network protocol. The device may use backup channels of communications including telephone and cellular network communications. All communications with the device, whether to monitoring receiver or other local devices, may be secured with a minimum AES 128-bit encryption.

25 Claims, 6 Drawing Sheets

SECURITY MONITORING METHODOLOGY USING DIGITAL AUDIO

BACKGROUND OF THE INVENTION

1. Field of the Invention

The present invention relates generally to physical security monitoring and physical access control where bi-directional communications is provided via a digital network and audio signals are used in the assessment of physical security alarm events.

2. Description of Related Art

Many conventional alarm monitoring systems provide the ability to configure listen-in assessment or "two-way voice" features by connecting panel equipment connected to an alarm premises to a telephone handset of an operator within a monitoring center. This conventional method uses analog telephony and the audio channel "piggy-backs" on the alarm transmission. One company that uses this method in a high-volume commercial central monitoring center is Computerized Monitoring Services (CMS) in Longwood, Fla.

Sonitrol Corporation in Berwyn, Pa. offers a sophisticated approach to monitoring simultaneous analog audio signals by a single operator, employing proprietary telephone receiving equipment. However, in this method, the receiver equipment does not provide the ability to route the audio signals among available workstations, creating limitations to scale and workstation efficiency.

In addition, with dial-up applications, there is no ability for the monitoring system to supervise the availability of the field panels, and the length of time to establish communications can take on the order of 10 seconds or more. The only alternative, using analog telephony is costly dedicated telephone lines.

Further, in applications requiring the delivery of security data and assessment audio from a physical security panel to a monitoring center over a secure digital network, no commercial solution currently exists because of the extensive design and development required for the system-level components, of which the subject device is one, and infrastructure support software, drivers and middleware for the monitoring environment.

SUMMARY OF THE INVENTION

Therefore, a need exists for a system infrastructure to be developed for routing digital audio streams to disparate monitoring workstations, and within the workstations, and for simultaneously monitoring audio from multiple locations, with the ability to visibly correlate the audio sources to the correct locations.

The use of digital networks for communications provides much faster connection time (typically less than one second) and the ability to supervise communications at low cost.

An object of the present invention is to improve the quality of service in the fidelity of audio monitoring and recording.

Another object of the present invention is to provide a secure channel for communications.

A further object of the present invention is to provide a cost-effective means for supervising field equipment and provide much greater efficiencies of scale within the central monitoring center environment, in that individual channels of audio may be routed according to workstation availability.

A further object of the present invention is to provide a means for monitoring many audio streams (up to 48) with a single, or pair, of speakers, using visual indicators on a computer monitor to correlate audible security monitoring sounds with the location from which the sound is originating, exploiting the fact that secured, unoccupied, facilities are typically quiet, and significant levels of audio, in such premises, are relatively infrequent except in cases where the causes of such audio levels should be investigated.

It is also to be understood that all features noted above need not be included in a given embodiment in order for the embodiment to fall within the scope of the present invention, and that not all deficiencies noted in the prior art need be overcome by a given embodiment in order for it to fall within the scope of the present invention.

BRIEF DESCRIPTION OF THE DRAWINGS

Embodiments of the present invention are shown in the accompanying drawings in which.

DETAILED DESCRIPTION OF THE EMBODIMENTS

In the following description, it is to be understood that the use of relational terms, if any, such as first and second, top and bottom, left and right, and the like are used to distinguish one from another entity or action without necessarily, by themselves, requiring or implying any actual such relationship or order between such entities or actions.

Figure 1:
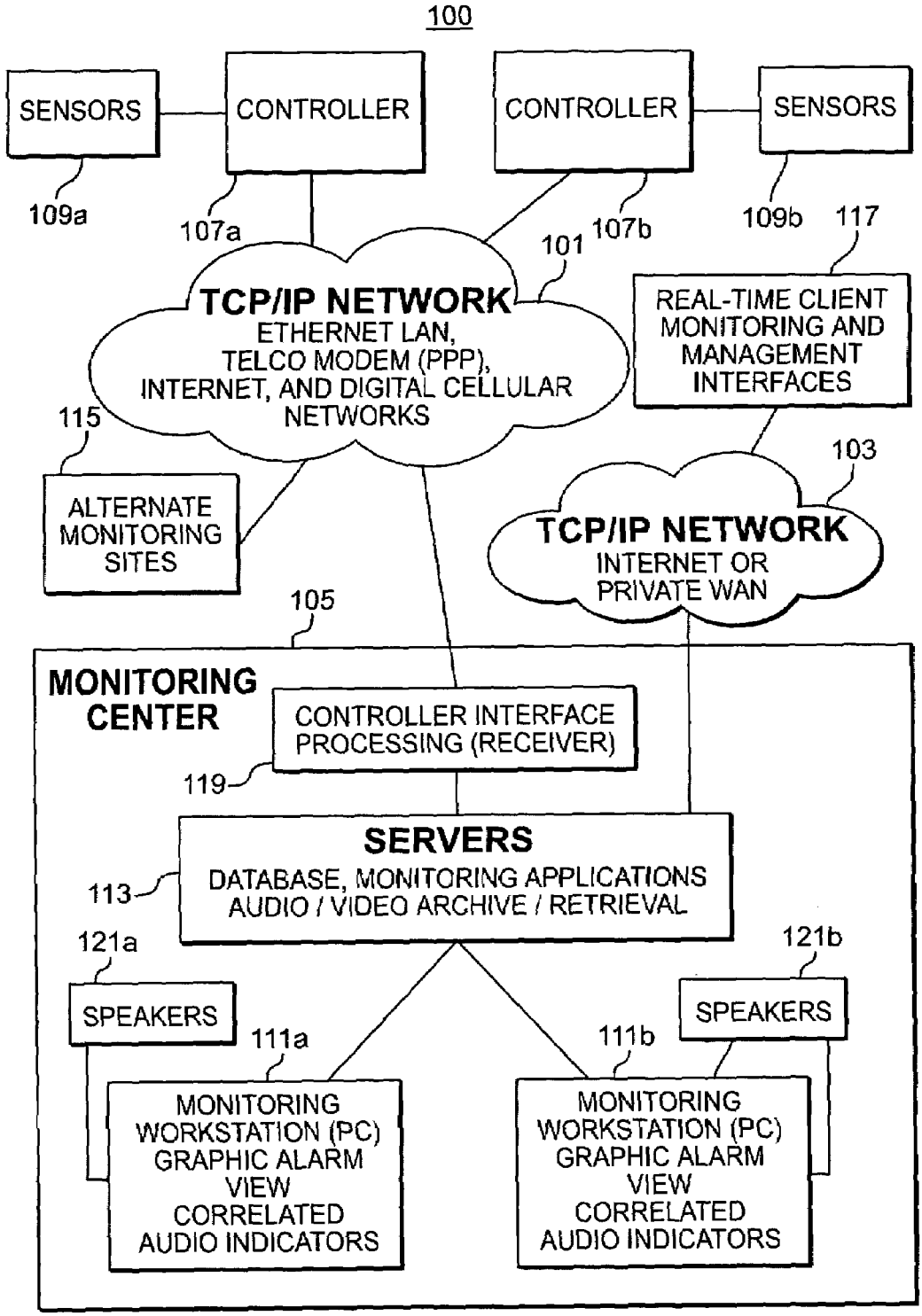
FIG. 1 is a block diagram of a security system according to one embodiment of the present invention.

As shown in FIG. 1, an overview of a security monitoring system 100 includes a TCP/IP Network 101 and 103 in the top half of the drawing and a monitoring center 105 in the bottom half of the drawing.

The present invention overcomes the limitations of the prior art by using high-speed network connections to the monitoring center 105. The TCP/IP Network 101 may be an Ethernet LAN, Telco Modem (PPP), Internet, or digital cellular network. The TCP/IP Network 103 may be the public Internet or a private LAN or WAN network. A cable-modem, DSL, or wireless connection can also be used.

A controller 107*a* and 107*b* connects to a number of microphones (not shown) installed at various locations in a facility being monitored or alternate monitoring sites 115. The controller 107*a* and 107*b* digitizes, compresses, and digitally records audio signals at an input thereof received from sensors 109*a* and 109*b*, respectively.

The signals are compressed into MP3 format. Real-time, streaming, MP3 formatted, audio signals are transmitted to the monitoring center 105 through any of the means of communications listed above, namely: Ethernet terminated TCP/IP network, telephone line, or digital cellular modem, in the event an alarm needs to be assessed.

Up to 32 controllers may communicate with each other over one of the following types of 'local' networks: RS-485;

Fiber optic network (single-mode or multi-mode), configured as a self-healing ring; or TCP/IP socket communications over Ethernet network.

Local network communications is carried out with or without access to the monitoring/database server 113.

The local network is used for communicating system-level functions for physical security and access control management.

Connection to the local network may be established via Ethernet, using two TCP/IP socket connections.

The controllers 107*a* and 107*b* are logically linked in a "ring" fashion. An Internet protocol (IP) address is assigned for an up-link controller and another address is assigned for a down-link controller. Each controller will hold the list of networked controllers. In the event of a communications failure, the controller will navigate through the list of controllers to establish an up-link connection. This method reduces the number of socket connections required of each controller to communicate within the system.

Alternatively, the controllers may connect to a local RS-485 network or self-healing fiber ring. In this case the controllers are identified with a bus module address.

The controller with module address "0" will act as the local network controller by default.

The controller with address "1" may take over as the local network controller, should network polling be discontinued. Once module "0" communications is restored while module "1" is polling, module "1" will then pass network control back to module "0."

Many types of sensors 109*a* and 109*b* may be used, depending on the specific application for which the security system is designed. Sensors 109*a* and 109*b* may be for fire, smoke, breakage, opening/closing, or motion, for example. The sensors 109*a* and 109*b* are remotely located at the facility being monitored to detect the occurrence of a triggering event.

Audio sent over the TCP/IP Network 103 from real-time client monitoring and management interfaces 117 is transmitted to the monitoring center 105 through server(s) 113.

The security monitoring system 100 scales from a single personal computer (PC) or workstation 111*a* and 111*b*, incorporating all server and workstation functions, to a network of multiple, load balanced 'web' or real-time replicated database servers 113, and multiple workstations depending on the alarm activity to be received the monitoring center 105. The server(s) 113 are operable to provide services including a database, monitoring applications, and audio, video archive, and retrieval.

Data and audio signals are routed to various monitoring workstations 111*a* and 111*b* based on traffic and operator availability. Remote workstations (not shown) are supported for remote access to views on the monitoring activity, based on user authority.

The operator workstation (not shown) provides prioritized textual display of alarm events, graphical annunciation, control for video switching equipment, and the control and reproduction of audio signals for alarm assessment.

When the monitoring server receives an alarm signal from a controller, the alarm event is routed to a monitoring workstation for processing and a socket connection is created from the server to the workstation for replicating the streaming audio signal from the controller, in the event an audio stream is available.

Audio from this stream is decoded and processed in real time, by the monitoring workstation, to give a visual indication, on the screen, of the peak audio levels being generated at the account.

Figure 2:
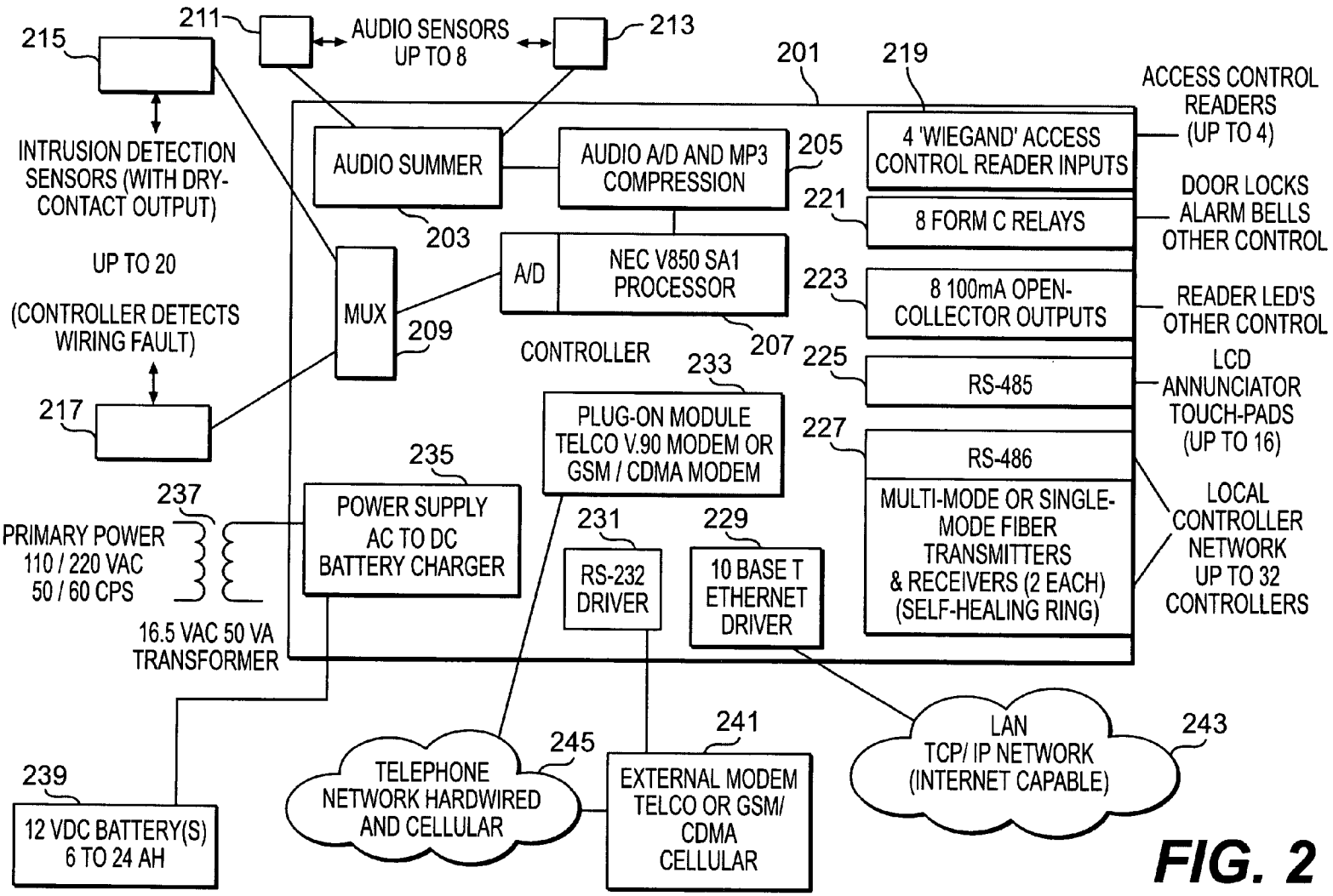
FIG. 2 is a block diagram of a controller according to one embodiment of the present invention.

Audio is then combined with any other active audio streams from other controllers, and is then delivered to the sound card for reproduction on the workstation speakers. Referring to FIG. 2, a system functional block diagram is shown representing digital audio processing for a universal controller 201.

The controller 201 may include a Micronas MAS 3587F chip 203 for digitizing summed audio signals from the microphone inputs. The chip 203 may be configured for various bit-rate encoding, depending on the available network bandwidth.

Chip 203 also includes capability for encoding the audio stream into MP3 formatted, compressed audio represented by block 205. Up to 8 audio sensors 211 and 213 are input to an audio summer 203 on the controller.

The main processor for the controller 201 may include an NEC V850 SA1 chip 207. The processor code includes a TCP/IP stack and AES encryption algorithm for securing communications.

Sensors 215 and 217 may have 'dry contact' output. Up to 20 sensor inputs 215 and 217 are connected to a multiplexer 209, the output of which is coupled to the A/D converter input of the processor chip 207. The A/D converter allows the input voltage level to be monitored in three configurable ways: 1) no end-of-line resistors for 2-state monitoring, 2) 1 end-of line resistor, for 3-state supervision or 3) 2 end-of-line resistors for 5 state monitoring.

The controller 201 is special hardware that provides outputs for alarm annunciation, access control, and other control functions.

The controller 201 provides access control via reader inputs 219 for up to 4 readers, with 'Wiegand' type interface. This access control includes real time activity reporting and local activity log buffering.

The controller 201 provides other control functions, for example, door locks, and alarm bells via up to 8 relays 221. The relays may be of the Form C type.

The controller 201 provides further control, for example reader LEDs via up to 8 open-collector outputs 223. The outputs may drive external devices, such as relays, up to 100 mA.

The LEDs indicate address conflicts with another device, communication status, including the self-healing ring channel operational status, battery status, power supply status for each output (relay and open-collector), and AC power indication.

The controller 201 also provides user interfacing for up to 16 liquid crystal display (LCD) modules, with touch screen or pads, connected to the controller 201 via an RS-485 communications interface 225.

All communications are encrypted with AES encryption.

The primary encryption key is entered manually, via a hardwired LCD keypad. The key is also input into the server database 113 via secure SSL connection. Controller encryption keys are also encrypted in the monitoring server database.

A display module may be configured, through programmable options downloaded to the device, to display a sequential numeric code entry screen, a random sequence numeric code entry screen, or a sequential code entry screen, with a random starting number.

When the controller 201 establishes a connection with the server, a new 128-bit AES session key is created, is encrypted with the controller's primary key, and is then sent to the controller.

The controller acknowledges the message using the new session key. Each message is tagged with a sequential number, and when this number rolls over a new key is generated by the server and passed to the controller 201 to ensure that no message is repeated.

System setup options may be configured to enable the controller 201 and monitoring station 111*a* and 111*b* to continuously monitor communications status. The monitoring station 111*a* and 111*b* may alert responders, should communications with the device be interrupted.

Via an Ethernet connection, the controller 201 may establish "always on" socket communications with the monitoring server 113. The "always on" feature provides detection of alarms to assess whether events such as door opening/closing are triggering events.

The monitoring server 113 will continuously monitor communications with the controller 201 and will report whenever communication is interrupted, meeting requirements for UL grade AA supervision.

The controller 201 is combined with a system-level processing methodology, to create an alarm monitoring system encompassing physical intrusion detection, with audio assessment, and physical access control.

The controller 201 has multiple communications interfaces to a LAN, TCP/IP network, Internet 243 and a telephone network, both hardwired and cellular 245, including Ethernet driver 10BaseT 229, multi-mode or single-mode fiber optics interfaces 227, optional CDMA or GSM digital cellular modem interface via RS-232 driver 231, and serial modem interface for digital telephony communications via plug-on module 233.

An embedded TCP/IP stack is provided for digital network communications, including Internet communications. The controller 201 may be configured, depending on the field application, to use any communications method as the primary means of communicating with the monitoring equipment, and any other communications means may be used as backup communications should the primary channel become unavailable. The system may be configured to supervise controller communications, generating an alarm should communications be interrupted. When communications is interrupted, the controller 201 will attempt to contact the monitoring center 105 on an optioned backup communications channel.

The controller 201 also has a power supply 235, which may be an AC to DC battery charger coupled to a transformer 237 and a DC battery 239. The primary side of the transformer 237 may operate at 110/220 VAC and 50/60 cps and the secondary side may operate at 16.5 VAC and 50 VA. The battery 239 may be a 12-volt DC battery operating, with optional battery configurations, from 6 to 24 AH.

The controller 201 provides means for digitizing and compressing the audio input signals from audio sensors 211 and 213 into compressed data. Audio data is buffered in the random access memory (RAM) of the controller 201 such that a minimum of one second of 'past' audio input data is continuously stored in a 'circular buffer,' the oldest data being overwritten on each update. After an alarm event is triggered, and the event has been configured to use audio for assessment, the monitoring station may begin receiving the buffered audio, allowing the audio leading up to, including, and after the event to be assessed. Thus, the controller 201 may transmit audio data streams over a digital network that corresponds to a period of time preceding the triggering event.

Universal controller functional specifications FS-90900, Infrasafe, Aug. 1, 2004, provide the overview and operation of the controller's intrusion detection and access control features, including the communications protocol with the monitoring system.

Figure 3:
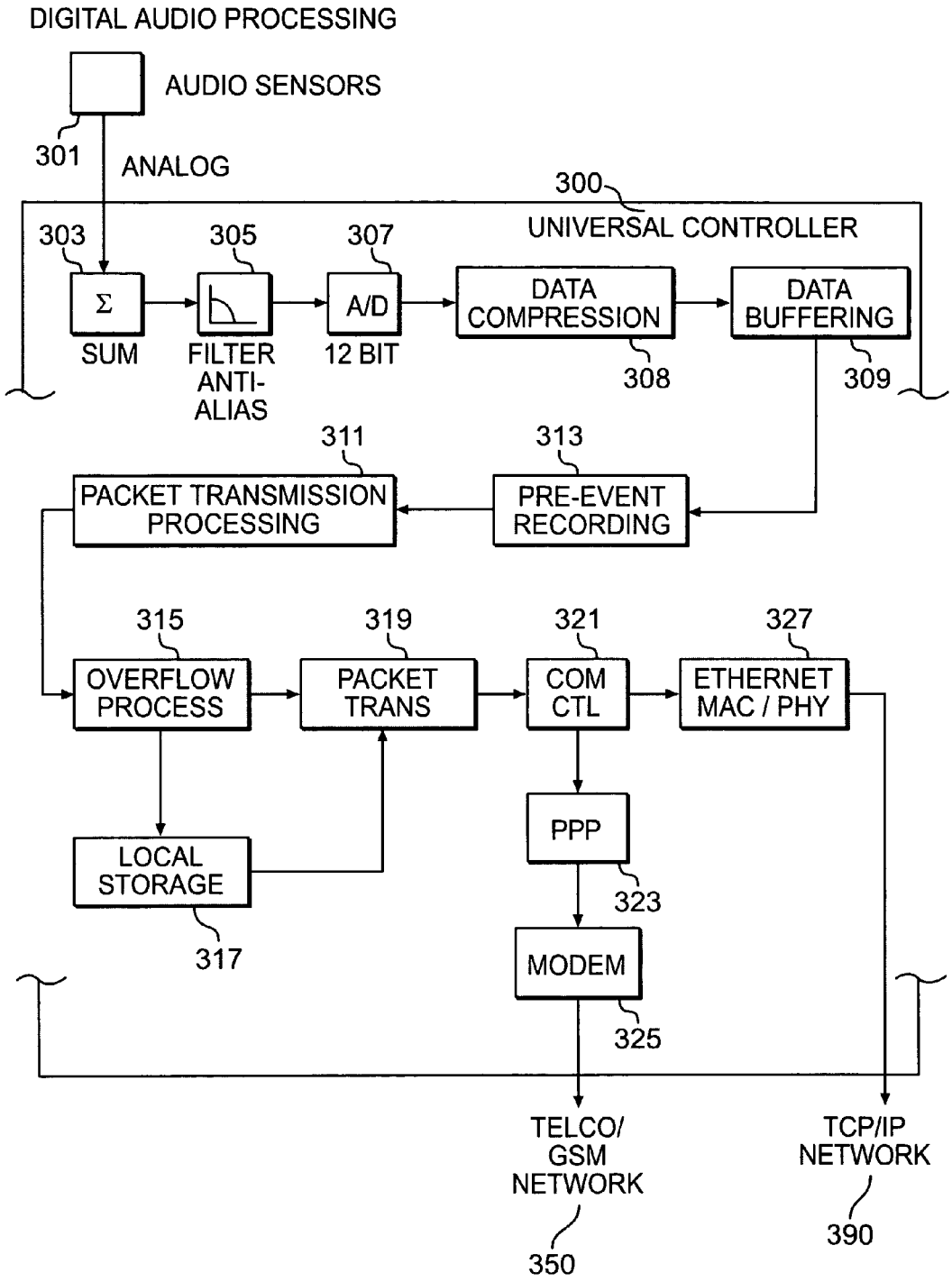
FIG. 3 is block diagram of a digital audio process according to one embodiment of the present invention.

FIG. 3 is block diagram of a digital audio process. The process includes a universal controller 300, a TELCO or GSM network 350, and a TCP/IP network 390. A single facility may be controlled by one or more universal controllers 300.

When audio sensors 301 receive a signal at the facility being monitored, the signal(s) is (are) sent to the universal controller 300, which includes a summer 302. The signal is filtered 305 (using for example and anti-alias filter) and converted to a digital signal 307.

Next, the data signal is compressed 308 and buffered 309. Next, the compressed signal goes through packet transmission processing 313 which includes overflow processing 315 for local storage 317. If a triggering event has occurred, the signal is transmitted as a packet 319 through a communication controller 321 by selecting networks to transmit the data including a point-to-point protocol (PPP) connection 323 through a modem 325 to the TELCO or GSM network 350, and an Ethernet interface 327 to the TCP/IP network 390. The device-specific Ethernet interface provides a physical (PHY) interface in combination with media access control (MAC) function.

The monitoring center 105 may include digital audio processing over more than one server.

Figure 4:
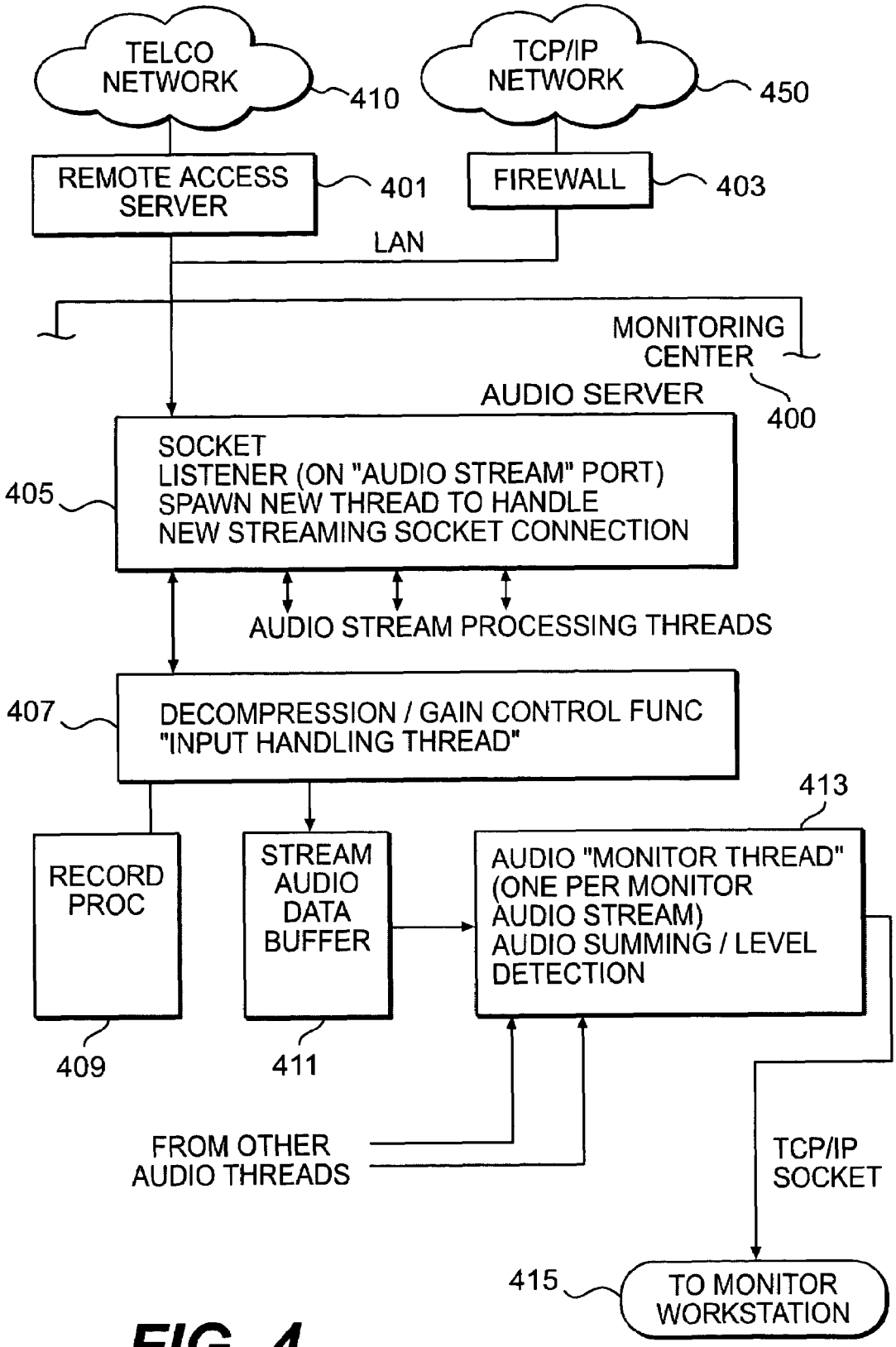
FIG. 4 is a block diagram of multiple audio servers processing according to one embodiment of the present invention.

FIG. 4 is a block diagram of multiple audio server processing. All server and workstation processes may reside on a single machine, for small scale applications. The signals can be transmitted over multiple servers using both the TELCO network 410 and the TCP/IP network 450. The TELCO network 410 is coupled to a remote access server 401 to make PPP (point-to-point) connections from controllers via telephone or cellular modem. A TCP/IP network interface, such as the Internet, 450 is typically connected through a firewall 403.

The socket listener 405 provides listening on audio stream ports and for spawning a new thread to handle new streaming socket connections. The socket listener 405 spawns new audio stream processing threads for decompression and gain control functions 407.

The decompression or gain control function is an input handling thread. The input handling thread is sent to record processing 409 and to a stream audio data buffer 411.

Next, an audio "monitor thread" (one per monitor audio stream) for audio summing and level detection 413 receives the audio stream from the buffer 411 and from other audio input threads. Thus, the controller processes input data from remote sensor devices for storage as multiple data streams to be routed over a network. The detected audio is transmitted on a TCP/IP socket to a monitor workstation 415. The digital signals received may also be non-audio signals.

Figure 5:
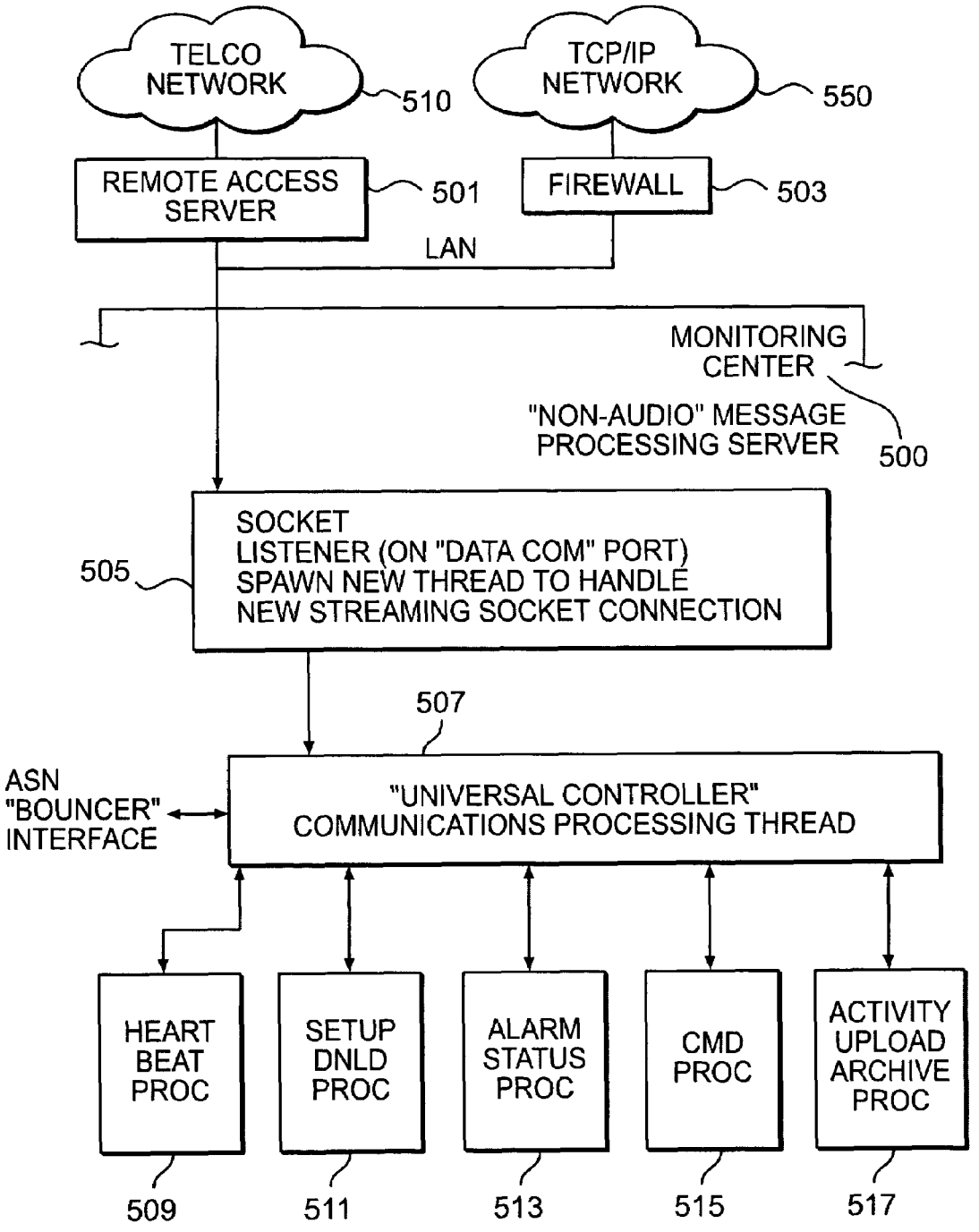
FIG. 5 is a block diagram of multiple non-audio server processing according to one embodiment of the present invention.

FIG. 5 is a block diagram of multiple non-audio server processing. Similar to FIG. 4, multiple server processes may reside on a single machine for small scale applications.

The signals can be transmitted over multiple servers using both the TELCO network 510 and the TCP/IP network 550. The TELCO network 510 is coupled to a remote access server to make PPP (point-to-point) connections from controllers via telephone or cellular modem. A TCP/IP network interface, such as the Internet, 550 is typically connected through a firewall 503.

After one of the networks receives a signal, it forwards the signal through the server 501 or the firewall 503 over the LAN for sending the signal to at least one monitoring center 500 on a socket 505 on an non-audio server or message processing server.

The socket 505 provides listening on "data communication" ports and for spawning a new thread to handle new streaming socket connections. The socket 505 sends non-audio signals to a universal controller 507. The universal controller 507 is a communication processing thread. The communication processing thread is sent to one of a heartbeat processing 509, setup, options download, alarm status processing 513, command processing 515, and activity reporting 517.

After the server processes the audio or non-audio signal, the signal is transmitted to a monitoring workstation 111*a* or 111*b*.

Figure 6:
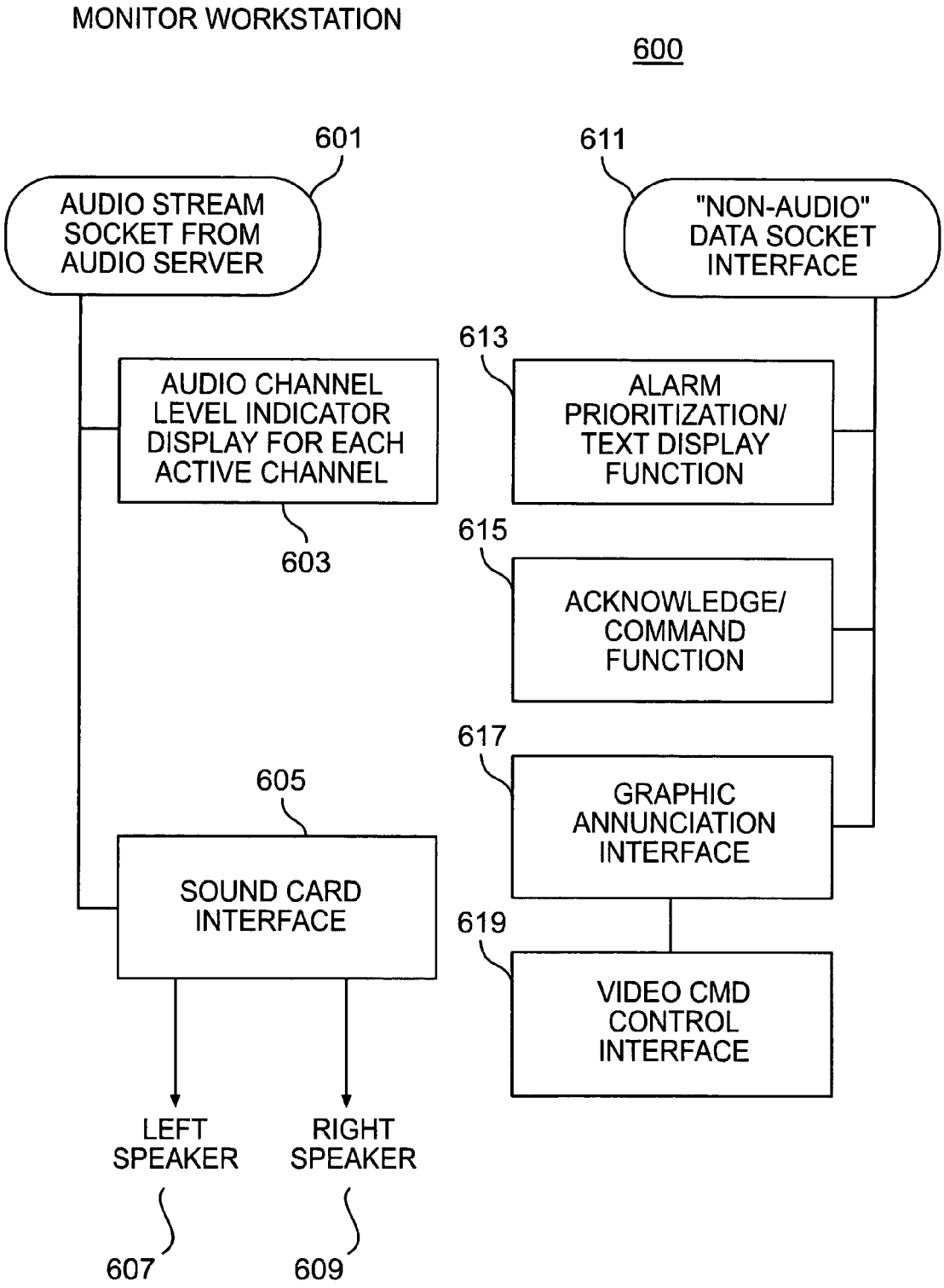
FIG. 6 is a block diagram of a monitor workstation according to one embodiment of the present invention.

FIG. 6 is a block diagram of a monitor workstation 600. The monitoring workstation 600 sends a signal on one of an audio stream socket 601 from the audio server or a non-audio data socket interface 611. Thus, the security monitoring system integrates audio and non-audio verification schemes.

The signal sent on the audio stream socket 601 has an audio channel level indicator display 603 for each active channel and a sound card interface 605 for a left speaker 607 and a right speaker 609.

The signal sent on the non-audio data socket interface 611 has an alarm prioritization or text display function 613, an acknowledge command function 615, a graphic annunciation interface 617, and a video command control interface 619.

Therefore, the present invention provides a system infrastructure for routing digital audio streams to disparate monitoring workstations, and within the workstations, and for simultaneously monitoring audio from multiple locations, with the ability to visibly correlate the audio sources to the correct locations.

The digital networks used in the present invention for communications provides much faster connection time (typically less than one second) and the ability to supervise communications at low cost.

The present invention improves the quality of service in the fidelity of audio monitoring and recording.

The present invention provides a secure channel for communications by encrypting all communications.

The present invention provides a cost-effective means for supervising field equipment, such as remote sensors and provides much greater efficiencies of scale within the central monitoring center environment, in that individual channels of audio may be routed according to workstation availability.

It is to be understood that the above discussion provides a detailed description of the embodiments of the present invention.

The above descriptions of the embodiments will enable those skilled in the art to make many departures from the particular examples described above to provide apparatus constructed in accordance with the present invention. The embodiments are illustrative, and not intended to limit the scope of the present invention.

The invention claimed is:

1. A universal controller comprising:

two or more inputs that receive signals from two or more audio sensors;

a data compressor that compresses signals received from the audio sensors into compressed data comprising at least compressed audio data, said data compressor in communication with said two or more inputs to receive the signals from the audio sensors;

a buffer in communication with said data compressor to store the compressed data;

a detector in communications with said data compressor to receive the compressed data and determine when a triggering event has occurred; and a packet transmitter that transmits the compressed data to disparate locations in response to the determination of the triggering event, wherein the transmitted compressed data comprises not only audio data which corresponds in time to the triggering event but also buffered audio data which corresponds in time with a predetermined amount of time preceding the triggering event.

2. The universal controller as recited in claim 1 further comprising a communications controller in communication with said packet transmitter, said communications controller selecting from two or more networks to transmit the compressed data.

3. The universal controller as recited in claim 1 further comprising an encryption device in communication with said packet transmitter, wherein said encryption device encrypts the compressed data before the transmitter transmits the compressed data.

4. The universal controller as recited in claim 3 wherein the encryption device uses AES encryption.

5. The universal controller as recited in claim 1 wherein the universal controller further comprises:

at least one input that receives signals from a detection sensor;

wherein the data compressor further compresses signals received from the detection sensor, and wherein compressed detection sensor data may be used to determine when a triggering event has occurred.

6. The universal controller as recited in claim 1 wherein the signals are digitized and compressed into MP3 format.

7. The universal controller as recited in claim 1, wherein the audio sensors are distributed among multiple locations in a single facility, and wherein the transmitted compressed data comprises sufficient information to correlate the compressed audio data with the locations of the audio sensors where the compressed audio data respectively originate.

8. A method of processing signals received from security systems, comprising:

receiving two or more audio input signals from two or more audio sensors;

summing the two or more audio input signals;

digitizing the summed two or more audio input signals;

compressing the digitized signals as data;

buffering the compressed data;

detecting the compressed data to determine when a triggering event occurred; and transmitting the compressed data to disparate locations in response to the determination of the triggering event in substantially real-time, wherein the transmitted compressed data comprises not only audio data which corresponds in time to the triggering event but also buffered audio date which corresponds in time to a predetermined amount of time preceding the triggering event.

9. The universal controller as recited in claim 8 further comprising selecting from two or more networks to transmit the compressed data.

10. The method as recited in claim 8 further comprising encrypting the triggering event data before it is transmitted.

11. The method as recited in claim 8 wherein the compressed data is transmitted over the Internet.

12. The method as recited in claim 8, wherein said audio sensors are distributed among multiple locations in a single facility, the method further comprising transmitting information sufficient to correlate the audio data with the locations of the audio sensors where the data respectively originate.

13. The method as recited in claim 8, the method further comprising:

receiving the compressed data comprising the audio data at one of said disparate locations;

receiving the information at said one of said disparate locations; and simultaneously reproducing an audio signal representative of said audio data and presenting in a graphical user interface at least one visual indicator representative of the location of the audio sensor where said audio data originated, thereby correlating the audio signal with the location of the corresponding audio sensor.

14. The method of claim 8, the method further comprising:

receiving the compressed data at a server at a monitoring center; and routing data from the server to disparate monitoring workstations for alarm assessment monitoring, wherein data is routed from the server to a particular one of said monitoring workstations based at least on traffic or operator availability.

15. A security control system, comprising:

remote sensor devices to detect when a triggering event has occurred, wherein at least two of said remote sensor devices simultaneously monitor audio;

controller devices for processing input data from the remote sensor devices for storage as multiple data streams, and for routing the data streams over networks, wherein at least two of said input data comprises audio data;

memory devices for buffering the input data; and network interfaces providing communications between the controller and one or more networks, wherein each one of the controller devices is connected to a plurality of the sensor devices; and wherein, upon detection of a triggering event, the controller devices transmit not only the audio data streams which correspond in time to the triggering event, but also the buffered audio data streams which correspond in time to a predetermined amount of time preceding the triggering event.

16. The security control system as recited in claim 15 wherein the controller is coupled to one of the networks via a high-speed network connection.

17. The security control system as recited in claim 16 wherein the high-speed network connection is selected from the group consisting of: a cable-modem connection an x-DSL connection, a wireless connection.

18. The security control system as recited in claim 15 further comprising user interfaces coupled to the controller devices.

19. The security control system as recited in claim 15 wherein the networks are digital networks.

20. The security control system as recited in claim 15 wherein at least one of the networks is a backup network selected from the group consisting of: a telephone network, a cellular network.

21. The security control system as recited in claim 15 further comprising alarm input wiring connected with the sensor devices and configured for one of two-state monitoring with no end-of-line resistor, three-state monitoring with one end-of-line resistor which monitors an alarm switch and the status of the alarm input wiring, and five state monitoring with two end-of-line resistors which monitors an alarm switch, a tamper switch, and the wiring status with a single input.

22. The security control system as recited in claim 15 further comprising an off-the-shelf user control and annunciation module connected with the controller and consisting of a back-lit LCD display, with touch-screen, and wherein all of the display output of the module, and touch-coordinate input, is processed by the controller, and wherein the module is configurable to provide a user with one of a standard numeric key sequence, a direct sequence with the beginning numeric key chosen randomly, and a randomized sequence of numeric keys.

23. The security control system as recited in claim 15 further comprising: at least one speaker coupled with a monitor having visual indicators to correlate audible security monitoring sounds with the location from which a sound indicating a triggering event is originating.

24. The security control system as recited in claim 15, wherein the controller device selects from two or more networks to transmit the compressed data.

25. The security control system as recited in claim 15 wherein said remote sensor devices are distributed among multiple locations in a single facility, and wherein said controller devices further transmit sufficient information to correlate the audio data streams with the locations of the remote sensor devices where the data respectively originate.

* * * * *

UNITED STATES PATENT AND TRADEMARK OFFICE

CERTIFICATE OF CORRECTION

PATENT NO. : 7,411,490 B2
APPLICATION NO. : 11/117310
DATED : August 12, 2008
INVENTOR(S) : Perkinson et al.

It is certified that error appears in the above-identified patent and that said Letters Patent is hereby corrected as shown below:

Claim 8, Column 8, Line 57,
Please delete "date"
and
replace with
-- data --

Signed and Sealed this

Fourteenth Day of October, 2008

JON W. DUDAS
*Director of the United States Patent and Trademark Office*